United States Patent [19]

Sulzberger

[11] Patent Number: 4,773,231

[45] Date of Patent: Sep. 27, 1988

[54] SYSTEM FOR PREHEATING WATER USING THERMAL ENERGY FROM REFRIGERANT SYSTEM

[75] Inventor: Kevin J. Sulzberger, Orange, Calif.

[73] Assignee: TUI Industries, Anaheim, Calif.

[21] Appl. No.: 3,510

[22] Filed: Jan. 15, 1987

[51] Int. Cl.[4] ..... F25B 27/00

[52] U.S. Cl. ..... 62/238.6

[58] Field of Search ..... 62/238.6, 238.7, 512

[56] References Cited

U.S. PATENT DOCUMENTS

| | | | |
|---|---|---|---|
| 4,098,092 | 7/1978 | Singh | 62/238.6 |
| 4,293,323 | 10/1981 | Cohen | 62/238.6 |
| 4,356,706 | 11/1982 | Baumgarten | 62/238.6 |
| 4,507,933 | 4/1985 | Chapa et al. | 62/238.6 |

FOREIGN PATENT DOCUMENTS 0066425 5/1982 European Pat. Off. .

*Primary Examiner*—Lloyd L. King

*Attorney, Agent, or Firm*—Bogucki, Scherlacher, Mok & Roth

[57] ABSTRACT

A preheater system for using thermal energy available in a refrigeration cycle to heat potable water disposes a double-walled coil having an internal vent path within a water filled tank. Superheated refrigerant is passed through the coil downwardly between an inlet and an outlet. Liquid condensed within the coil accumulates in the bottom of a trap from which it is forced upwardly into a receiver tank and then returned to the refrigeration system. If excessive cooling develops, a pressure responsive valve shunts incoming superheated gas into the receiver tank to return to the selected operating range.

6 Claims, 4 Drawing Sheets

SYSTEM FOR PREHEATING WATER USING THERMAL ENERGY FROM REFRIGERANT SYSTEM

BACKGROUND OF THE INVENTION

Most commercial refrigeration systems utilize a halocarbon refrigerant (e.g. "Freon") in compression-expansion cycles which absorb heat (refrigerate) at the region to be cooled. However, the same refrigerant must give off heat because in the course of the cycle, after compression, it becomes heated to a gaseous state from which it must be cooled for efficient operation. it has long been recognized that the heat available in the superheated refrigerant can be utilized in preheating another volume or liquid. Thus there now are in use various types of preheater systems for the commercial establishments, e.g. supermarkets, hotels, restaurants, hospitals, which widely use closed cycle refrigeration systems and must also heat water.

In one preexisting type of preheater, now employed more than any other, water at normally supplied pressure and temperature is passed into a tank in which an inner wall comprises a hollow cylindrical heat exchanger member. The superheated refrigerant is fed through the interior of this member, which has a dimpled heat exchange surface, for thermal transfer to the body of water within the tank. By this heat exchange the heat taken up by the water cools the refrigerant adequately for the use in each cycle. This known system functions only with refrigeration systems which use an expansion valve receiver, thus not being available for about half of the installed refrigeration systems. Moreover, heat exchange with a peripheral wall in this manner is not efficient and the system is not capable of expansion or reduction if heat exchange needs change.

Another type of preheater system does not use a tank but comprises an external coil which includes an outer wall in which refrigerant passes about an interior tube in which water is passed in the opposite direction. This system is of low heat capacity, and limited efficiency, and requires field modifications including installation of a separate pump.

What is sought for preheating, therefore, is a system which will operate with virtually all refrigeration system types and will do so in a passive mode, requiring no system modification or extra power. The unit should not only be efficient but versatile in being expandable or contractible if a different number of compressors are to be used. The system should operate only in response to gravity and pressure flows of the refrigeration unit without regard to changing pressure or temperature conditions in the refrigerant or water supply during startup or long term operation. There should also be provision for protecting against contamination of potable water by the refrigerant and facility for adding refrigerant if needed.

SUMMARY OF THE INVENTION

A preheater system for use with a thermal energy from refrigerant systems receives superheated refrigerant at the input to a double-walled coil immersed in a hot water tank having a number of alternative fitting positions for receiving other heat exchange coils. The coil has a stainless steel outer wall and a copper inner wall with a continuous helical vent space therebetween that leads to the exterior of the tank, so that cross-contamination due to corrosion or other causes between the refrigerant and potable water is avoided, and a leakage condition can be detected. In the refrigerant flow path, the output refrigerant after heat exchange is passed through a lower U trap upwardly into a small receiver volume to which is also coupled a shunt line from the hot gas input. A pressure responsive valve along the shunt line opens when the pressure is below a preset level. In the event of overcondensing in the coil, the temperature and pressure drop excessively and hot gas is fed in the receiver tank via the input line and the pressure sensitive valve to return the contents to an acceptable pressure and temperature. The U trap serves as a collection zone for liquid condensed in the coils, which liquid cannot return back to the coils. A one-way check valve after and below the receiver tank prevents reverse migration of liquid into the receiver from the condenser to which the output is directed. Additional refrigerant may be added in at the receiver tank. Gravity flow and the normal refrigerant pressure thus assure stable operation under all modes in which the refrigeration and water systems may operate.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 1:
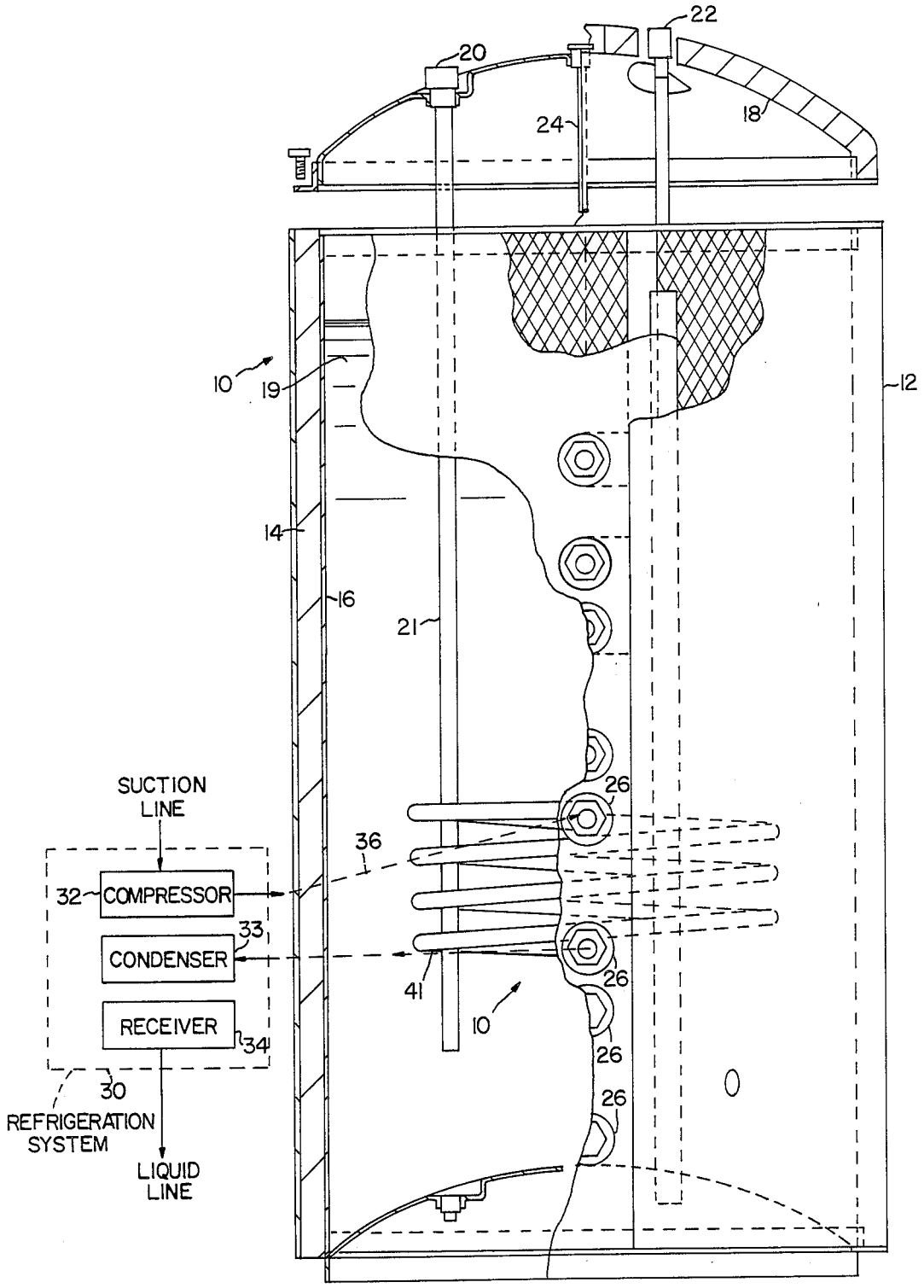
FIG. 1 is a side view, partially in section, of a heat exchanger tank incorporating heat exchange elements in a preheater system in accordance with the invention.
Figure 5:
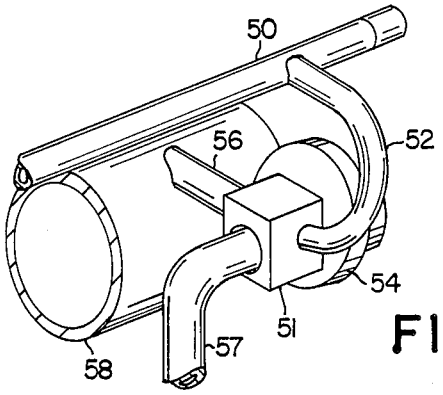
FIG. 5 is a different view of a portion of the arrangement of FIGS. 2 and 3, showing further details thereof.

A preheater tank 10 for heat recovery using a refrigerant fluid comprises a cylindrical body having a stainless steel cover 12 and a glass lined interior wall 16 separated by insulation 14. A removable dome 18 which can be detached to permit access to the interior includes a top inlet 20 for receiving water 19 at supply pressure and temperature and feeding it in via a downwardly extending inlet tube 21. The top dome 18 of the tank 10 includes an upper outlet 22 from which heated water passes to a utilization device (not shown). The top dome 18 also includes a corrosion anode in the form of a center bar 24 which extends downwardly through the principal interior length of the tank 10. Pairs of attachment fixtures 26 are disposed in side wall apertures at four different vertical positions along the length of the tank 10, for receiving interior coils at one or more positions, as described hereafter. These fixtures 26 comprise the apertures in the tank wall 16 plus the fittings described below.

Figure 2:
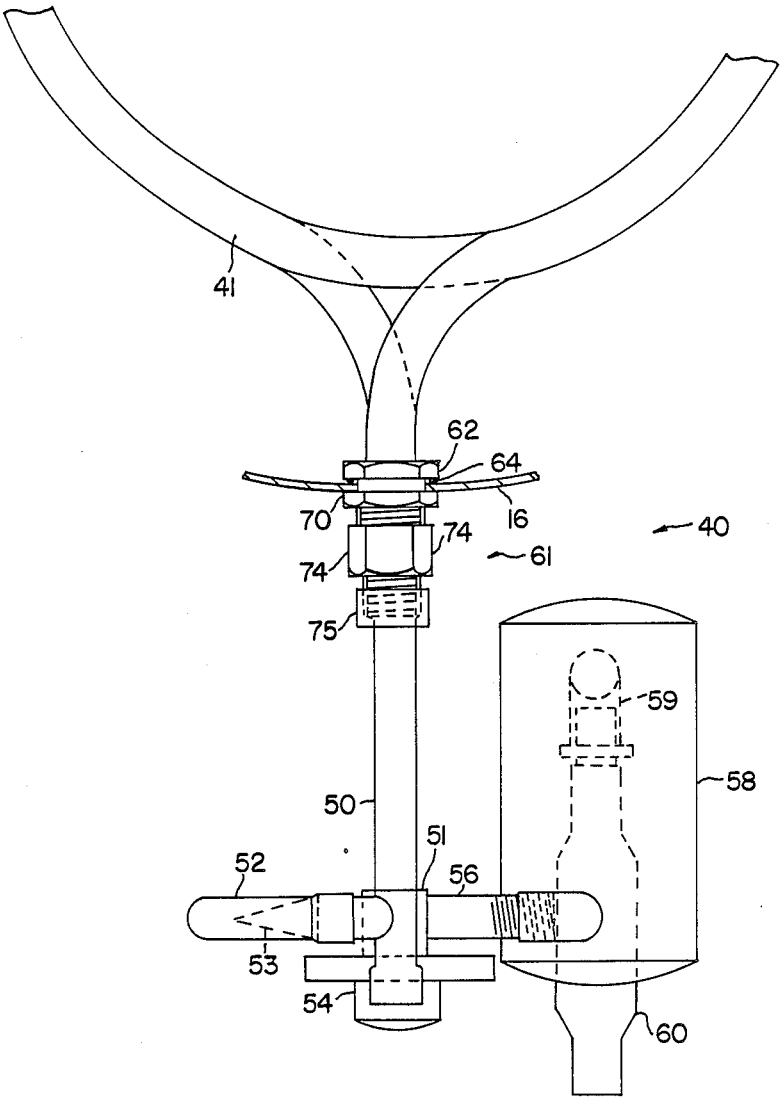
FIG. 2 is a top view of flow control and heat exchange components used in the system of FIG. 1.
Figure 6:
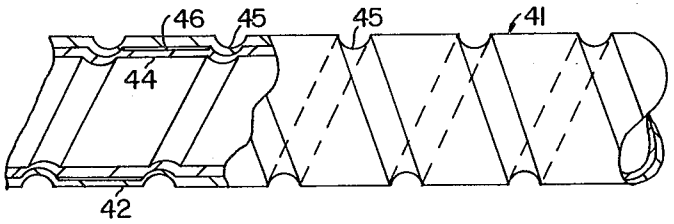
FIG. 6 is a fragmentary view, partially in section, of a double-walled heat transfer element in accordance with the invention.

A refrigeration system 30 shown only in general form includes the conventional compressor 32, condenser 33 and receiver 34. Superheated refrigerant on an input refrigerant line 36 is passed from the compressor 32 to a coil system 40, best seen in FIGS. 2–5, from which it is returned to the condenser 33 to be directed through the receiver 34 and then the evaporator (not shown) and finally a return to the compressor 32. Inasmuch as there are a wide variety of specific flow paths and elements that may be used that are immaterial to the operation of the preheater further details of the refrigeration system 30 have not been shown. The coil system 40 includes a helical coil 41, best seen in FIGS. 2 and 3, whose inlet is coupled to an upper one of a pair of attachment fixtures 26, while the outlet is coupled to the lower one of the same pair. The helical coil 41 comprises a double-wall structure having, as seen in FIG. 6, an outer stainless steel tube 40 and a copper inner tube 44. A helical depression 45 is impressed about the periphery to deform both of the tubes 42, 44 so as to form a radial thermally conductive path. The deformation also defines a helical vent space 46 (not shown to scale) which extends continuously along the length of the coil 41 to lead to an outer vent aperture, as described hereafter. The helical coil 41 has an approximately 1" outer diameter.

In the coil system 40, referring now particularly to FIGS. 2–5, the open end of an input line 50 is coupled to the refrigerant line 36 from the refrigeration system 30. A two input, single output junction 51 couples a shunt line 52 of U shape which includes a cone filter 53 for eliminating particulate matter that leads from the input line 50 to a pressure responsive valve 54. This valve 54 is of the type which normally opens the shunt line 52 to permit passage of hot refrigerated gas whenever the pressure on the downstream side drops below a selected level. A specific valve used here is a "Sporlan" valve manufactured by the Sporlan Company of St. Louis, Mo., with the couplings arranged for fitting into the geometry shown, wherein the junction 51 is immediately adjacent the pressure valve 54. An output line 56 from the junction 51 leads to a liquid receiver tank 58 of small volume, here approximately 3" diameter by 7½" in length. The receiver tank 58 is positioned above the level of the lowest turns of coil, and receives inflow via the line 56 which feeds tangentially in at its upper portion. The other input to the junction 51 is a U trap coupling 57 (FIG. 3) from the output fitting 26, the lowest (trap) part of this U coupling 57 being below the level of the lowest turns of coil 41 to entrap any condensed liquid until gas pressure forces it out. An output line 59 from the bottom of the receiver tank 58 comprises an elbow fitting that leads through a one-way checl valve 60 to the refrigeration system 30. The check valve 60 prevents the return of condensate back into the preheater.

Figure 3:
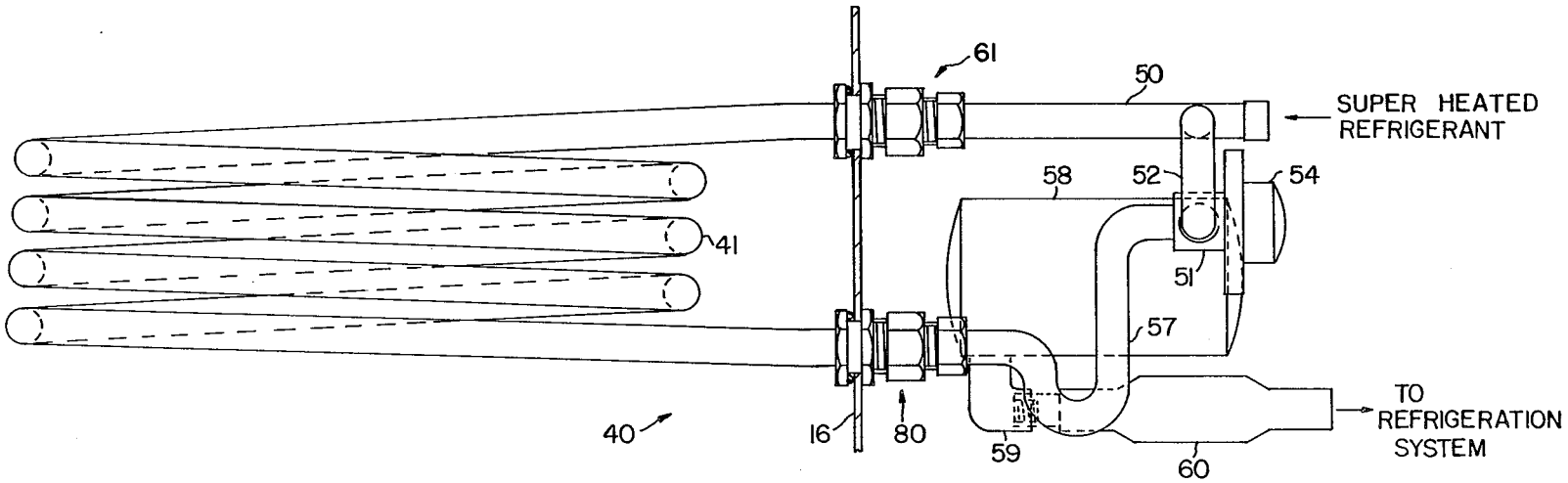
FIG. 3 is a side view of the arrangement of FIG. 2.
Figure 4:
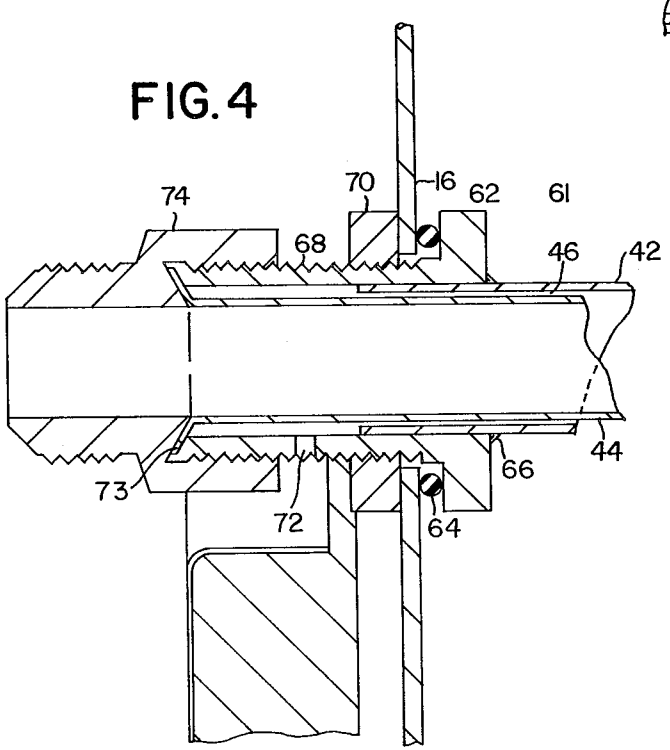
FIG. 4 is a side sectional view of an input fitting for use in the arrangemet of FIGS. 1–3.

Referring specifically to FIGS. 3 and 4, an input fitting 61 couples incoming refrigerant from the input line 50 into the helical coil 41 interior. Inside the tank wall 16, a base 62 for the fitting is separated from the wall by an O-ring 64 and is welded along a peripheral line 66 to the stainless steel outer tube 42 to prevent leakage of refrigerant into the water 19. A male thread 58 in the base 62 portion that extends outwardly from the wall 16 receives a flange nut 70 for tight fastening to the wall. This extension of the base 62 incorporates a vent aperture 72 which leads outwardly adjacent the fitting, to vent gas or water that may pass between the inner and outer walls of the coil 41. A detector may be used in this region to sense the existence of a leakage effect. As best seen in FIG. 4, the stainless steel outer tube 42 protrudes past the wall 16, but only to a limited distance, while the inner copper tube 44 extends fully to an end flange 73. An inverted flare coupling 74 has a female thread on one end for engaging the male thread 68 of the base member 62, to tighten against the end flange 73 on the copper tube so as to provide adequate sealing. A female threaded member 75 (FIG. 2) on the end of the input fitting 61 provides the base for attaching the input line 50.

At the output end of the coil system 40, an output fitting 80 (FIG. 3) of construction similar to the input fitting 61 feeds the cooled refrigerant through the U trap coupling 57. This fitting 80 is essentially like the input fitting 61 and need not be discussed in detail.

In the operation of this system, it is assumed that a single compressor 30 requires only one coil system 40 for providing adequate cooling of the superheated refrigerant. However, two or more coil systems 40 may be mounted internally of the tank 10 and operated in parallel if further capacity is needed. Also, if the compressors from other refrigeration systems become available, additional coils may be mounted in the tank as described herein for providing cooling for these sources, and additional heating of the input water. Referring now to FIGS. 2–5, the superheated refrigerant moves through the input line 50 and the input fitting 61 into the coil system 40 where it passes in heat exchange relationship via the double walls of the coil 41 with the surrounding water. If corrosion occurs, the leakage water starts into the vent space 46 between the helical depressions 45 and the tube sections, the vented gases are carried in the vent space back out to the vent apertures 72 in the input fitting 61 and output fitting 80. This double-wall arrangement provides effective heat transfer with the necessary safety against leakage of contaminating refrigerant into the potable water system.

Under steady state conditions, the refrigerant is lowered in temperature so that some may liquefy and some remain in the gaseous phase in the coil system 40. Liquid flows under gravity into the U trap coupling 57. Gas moves through the coupling 57 and the junction 51 directly into the receiver tank 58. Refrigerant gas continues to move via the bottom output 59 line past the check valve 60 back to the refrigeration system 30. The condensed liquid, however, is first trapped in the lowest portion of the U trap coupling 57, which stops liquid from migrating back into the coil system 40 and staining that portion of the system. If liquid continues to collect, it closes off the trap and the normal operating pressure forces the liquid into the small receiver tank 58. If sufficient liquid collects in this tank 58 from supercondensation, it lowers the temperature and pressure within the receiver tank 58 to the level at which the pressure valve 54 responds. The pressure valve 58 is preset with respect to operating conditions for the refrigeration system 30. When the valve 54 opens, the shunt line 52 injects incoming hot refrigerant gas into the liquid receiver tank 58, raising the temperature and pressure to prevent overcolling. The output flow of refrigerant gas and liquid thus continues to the refrigeration ssytem 30 without substantial interruption. The check valve 60 stops refrigerant from migrating backwardly from the condenser back into the coil system 40.

This preheater system may be used with any of the principaly existing refrigeration systems. It operates in a passive manner, in that only gravity and normal operating pressures and temperatures are required to maintain flow under a range of conditions. These include starting operation with a tank of fully cold water, and running under widely varying refrigeration demands. Refrigerant can be added at the receiver tank 58 if needed, but stable operation can be maintained without adjustments. The relative positions and configuration of the flow elements provide dual buffering and control of liquefied refrigerant, together with the thermal energy needed for preventing adverse effects from overcondensation. Variations in the amount of cooling needed and liquefaction result in continued flow without overcondensation.

While there have been described above and illustrated in the drawings various modifications in accordance with the invention it should be appreciated that the invention is not limited thereto but encompasses all variations within the scope of the appended claims.

What is claimed is:

1. A preheater system for incoming supply water using thermal energy from a refrigeration system having superheated refrigerant vapor that is to be cooled, comprising:

a tank having an inlet and an outlet for passing the supply water therethrough and at least first and second spaced apart apertures for passing refrigerant through a wall thereof;

at least one coil assembly mounted within the tank and having external upper input and lower output terminals secured to the wall of the tank at the first and second spaced apart apertures, the coil assembly comprising multi-walled metal tubing configured in a multi-level continuous form, the tubing having a continuous venting space leading along the coil assembly between an outer wall and an inner wall;

superheated refrigerant supply means coupled to the input terminal of the coil assembly and including an input fitting attached to the tank at the first aperture and having an external vent in communication with the venting space;

enclosed vessel means defining an output refrigerant receiving volume;

output conduit means including an output fitting attached to the tank at the second aperture and including a U trap coupling the output terminal of the coil assembly to the vessel means, the U trap being positioned to collect liquid in the bottom thereof below the lowest part of the coil assembly;

refrigerant output means including a one-way check valve for providing output refrigerant flow from the vessel means; and pressure responsive valve means coupling the refrigerant supply means to the vessel means and operating in response to a lowering of pressure in the vessel means below a predetermined threshold to inject superheated refrigerant from the supply means into the vessel means.

2. A preheater system according to claim 1 wherein the tank includes an outer cover and a plurality of pairs of spaced apart apertures in the tank wal for receiving coil assemblies, the coil assemblies comprising a stainless steel outer tube and a copper inner tube and having a helical indentation therealong forming a radial thermally conductive path having a helical venting space therebetween.

3. A preheater system according to claim 2 wherein the system further includes a shunt coupling from the supply means to the vessel means for each coil assembly, wherein each coil assembly comprises a helical set of turns with an inner tube of the coil extending out from the tank wall longer than an outer tube to define a vent conduit between the vent space within the multi-walled tube and the vent outlet.

4. A system for using superheated refrigerant from a refrigeration system in a passive mode to heat incoming potable supply water comprising:

tank means including means for passing supply water through an internal volume and wall means defining a pair of vertically spaced apertures;

coil system means disposed within the tank means and including a pair of end portions positioned at the respective spaced apart apertures, the coil means including a length of vertically descending double-walled tubing between the upper and lower apertures, the tubing having a stainless steel outer wall and a copper inner wall and having both thermal contact therebetween and a venting path therealong for fluids;

input means receiving the superheated refrigerant and comprising an input fitting coupled at the upper aperture to the associated end portion of the coil system means and to the wall means and including means coupled to the venting path for allowing egress of the venting fluid;

output means receiving the refrigerant from the lower end portion of the coil means and coupled at the lower aperture to the associated end portion of the coil system means and to the wall means;

trap conduit means coupled to the output means and including a lower section below the lower aperture and a downstream section above the lower aperture;

enclosed vessel means disposed above the level of the lower section of the trap conduit means for buffering refrigerant in the system;

refrigerant output means below the vessel means for returning refrigerant to the refrigeration system and including check valve means for blocking reverse flow; and pressure responsive means including conduit means for diverting flow from the input means into the vessel means in response to pressures below a predetermined level.

5. A preheater system for incoming supply liquid using thermal energy from a refrigeration system having superheated refrigerant vapor that is to be cooled, comprising:

a tank having an inlet and an outlet for passing the supply liquid therethrough and at least a pair of spaced apart apertures for refrigerant in a wall thereof;

at least one coil assembly mounted within the tank and having external upper input and lower output terminals secured to the wall of the tank at the pair of spaced apart apertures;

a refrigerant vessel defining an output refrigerant receiving volume disposed externally of the tank;

an output conduit coupling the output terminal of the coil assembly to the refrigerant vessel;

a one-way check valve connected to receive refrigerant from a low portion of the refrigerant vessel for return to the refrigeration system a valve having an inlet that is connectable to receive refrigerant from the refrigeration system, a first outlet connected to the coil input terminal and a second outlet connected to the refrigerant vessel, the valve being responsive to pressure at the second outlet to pass refrigerant through the first outlet when the pressure is above a selected threshold pressure and to pass refrigerant through the second outlet when the pressure is below the selected threshold pressure.

6. A preheater system according to claim 5 wherein the output conduit includes a U trap extending below a lowest part of the coil assembly to collect liquid therein.

* * * * *

UNITED STATES PATENT AND TRADEMARK OFFICE

CERTIFICATE OF CORRECTION

PATENT NO. : 4,773,231

DATED : September 27, 1988

INVENTOR(S) : Kevin J. Sulzberger

It is certified that error appears in the above-identified patent and that said Letters Patent is hereby corrected as shown below:

Column 1, line 13, "it", second occurrence, should read -- It --.

Column 3, lines 58-59, "male thread 58" should read --male thread 68--.

Column 4, line 52, "pressure valve 58" should read --pressure valve 54--.

Column 4, line 58, "ssytem" should read --system--.

Column 4, line 63, "principaly" should read --principally--.

Column 5, line 55, "wal" should read --wall--.

Signed and Sealed this

Nineteenth Day of December, 1989

*Attest:*

JEFFREY M. SAMUELS

*Attesting Officer* *Acting Commissioner of Patents and Trademarks*